United States Patent [19]

Chow

[11] 4,230,420

[45] Oct. 28, 1980

[54] SEMI-SUBMERSIBLE PIPELAYING VESSEL HAVING AN IMPROVED PIPELAYING PATH

[75] Inventor: Fred I. Chow, Houston, Tex.

[73] Assignee: Brown & Root, Inc., Houston, Tex.

[21] Appl. No.: 950,860

[22] Filed: Oct. 12, 1978

[51] Int. Cl.[2] ..... B63B 35/04; F16L 1/04

[52] U.S. Cl. ..... 405/166; 114/265

[58] Field of Search ..... 405/158, 166, 167, 168, 405/169, 170; 114/265

[56] References Cited

U.S. PATENT DOCUMENTS

| | | | |
|---|---|---|---|
| Re. 29591 | 3/1978 | Lloyd | 405/166 |
| 3,894,503 | 7/1975 | McClure | 114/265 |
| 3,967,461 | 7/1976 | Rosa et al. | 405/167 |
| 3,987,640 | 10/1976 | Goren et al. | 405/170 |

FOREIGN PATENT DOCUMENTS

| | | | |
|---|---|---|---|
| 2535559 | 2/1976 | Fed. Rep. of Germany | 405/166 |

*Primary Examiner*—David H. Corbin

*Attorney, Agent, or Firm*—Kenway & Jenney

[57] ABSTRACT

A semi-submersible pipelaying vessel has an improved configuration and structure for laying pipe wherein the pipeline path extends along a port or starboard side of the vessel. The pipeline path passes through the upper deck member of the vessel and then through a supporting column member of the vessel. A cantilevered overhang or deck member extension is not required. The pipe is supported along the pipeline path by a plurality of pipeline supports for providing the pipe at the stern of the vessel with the correct inclination with respect to the water surface. The slotted column advantageously provides protection for the pipeline below the deck level with respect to lateral wave action forces and added vessel stability and/or work area efficiency.

8 Claims, 3 Drawing Figures

SEMI-SUBMERSIBLE PIPELAYING VESSEL HAVING AN IMPROVED PIPELAYING PATH

BACKGROUND OF THE INVENTION

The invention relates in general to pipelaying vessels and in particular to a semi-submersible pipelaying vessel.

Semi-submersible pipelaying vessels are well known. These vessels have a relatively low surface area exposed to the wave action. Hence, the semi-submersible structure provides excellent motion characteristics in the presence of wave action.

In the design of a semi-submersible vessel for a pipelaying operation, two basic configurations have been used. In one configuration, the pipeline path, (the path along which the pipeline lengths are processed to form the continuous pipeline which is payed out from the stern of the vessel), extends from the bow of the vessel, above the upper deck surface, to the stern of the vessel where it leaves the vessel and is thereafter supported by a trailing, downwardly inclined, ramp extension. In an alternate configuration, the pipeline path extends from the bow of the vessel, above the upper deck, to a stern position below the upper deck. The alternate configuration is implemented, according to the prior art, in one of two alternate embodiments. In the first of the alternate embodiments, the pipeline path extends longitudinally down the center of the barge, thereby dividing the upper deck work area into port and starboard halves. A ramp, cut into the deck section toward the stern of the vessel, supports the pipeline as the pipeline path extends below the deck surface. In the other alternate embodiment, according to the prior art, the pipeline path is placed outside of the upper deck support columns, so that, in effect, the upper deck surface of the vessel is extended beyond the supporting column elements. This embodiment provides a potential instability since a significant portion of the vessel weight is cantilevered outside the support columns. In addition, in each of the alternate embodiments, the traditional design found in standard pipelaying barges must be modified because of the required placement of the pipe path.

A principal object of the invention therefore is a semi-submersible pipelaying vessel wherein the pipeline path does not interrupt or divide the deck surface and wherein the pipeline path further does not require a ramp extension for pipeline support at the stern of the vessel. Other objects of the invention are a semi-submersible vessel which provides an efficient functional upper deck work area, which can advantageously use the pipelaying configuration of a conventional pipelaying barge, which provides protection against wave action for the pipeline as it exits from the semi-submersible deck area of the vessel near the surface of the water, and which provides cost-effective use of the vessel.

SUMMARY OF THE INVENTION

The invention relates to a semi-submersible pipelaying vessel having an upper deck member, at least one lower submersible buoyancy member, and a plurality of support or column members connected therebetween for supporting the upper deck member in an upward, spaced apart, relationship with the submersible buoyancy member. The vessel features a structure wherein at least one of the support members at a stern portion of the vessel has a longitudinally directed, vertical cut-away section aligned with a longitudinally directed pass-through opening of the upper deck. A pipelaying means, partially supported by and above the deck member for fabricating a pipeline from a plurality of pipelengths, has a plurality of operating stations arranged along a pipeline path. The path extends longitudinally of the vessel from an above deck position to a below deck position at the stern of the vessel. The pipeline path aligns with and passes through the pass-through opening and the one support vertical cut-away section. Thereby, the pipeline is partially shielded from lateral wave action forces by the at least one support when the pipeline is below the level of the deck member.

In particular aspects, the vessel features the at least one support member having a cut-away section extending substantially the entire height of the support between the deck and buoyancy member, and dividing the support member into port and starboard support subsections. Means can also be provided for adjusting the pipeline path in a vertical direction.

BRIEF DESCRIPTION OF THE DRAWINGS

Other objects, features and advantages of the invention will appear from the following description of a preferred embodiment taken together with the drawings in which.

DESCRIPTION OF THE PREFERRED EMBODIMENT

Figure 1:
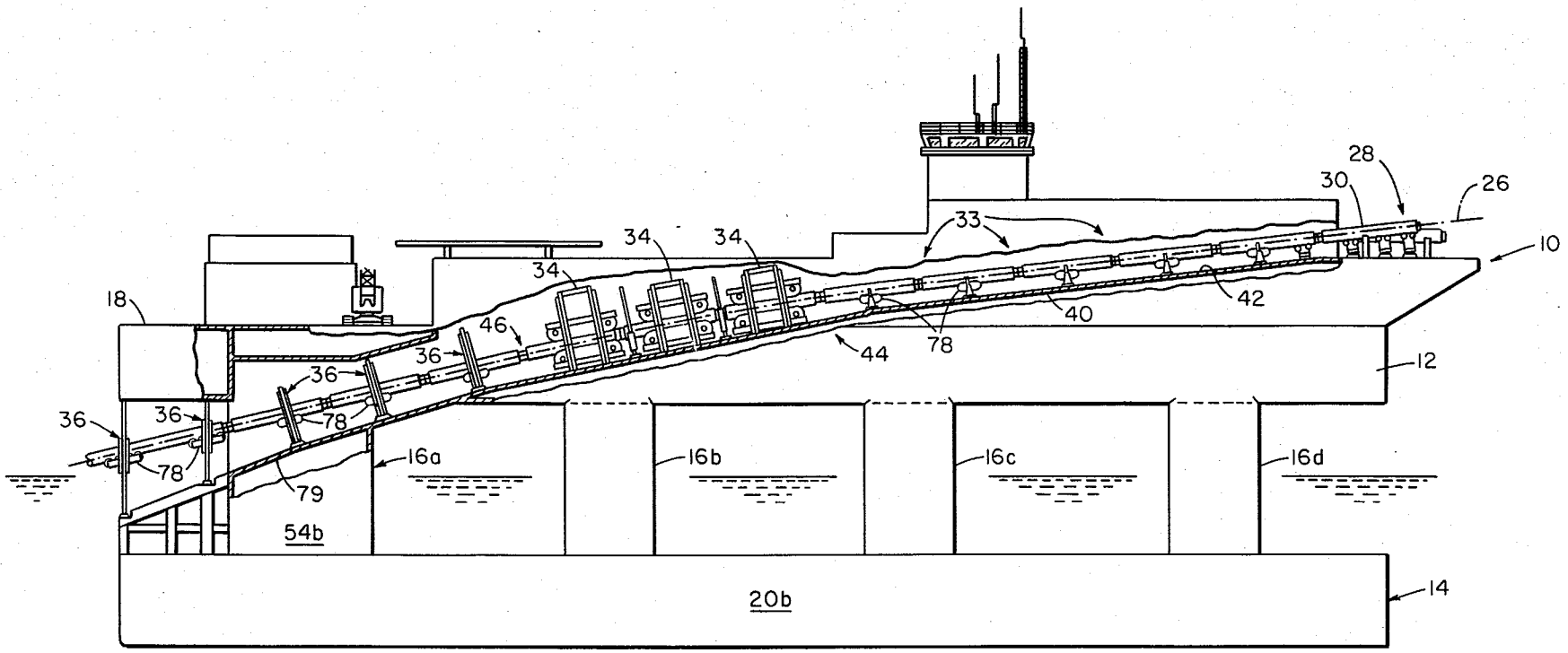
FIG. 1 is a side elevation view of a semi-submersible vessel constructed according to the preferred embodiment of the invention.
Figure 3:
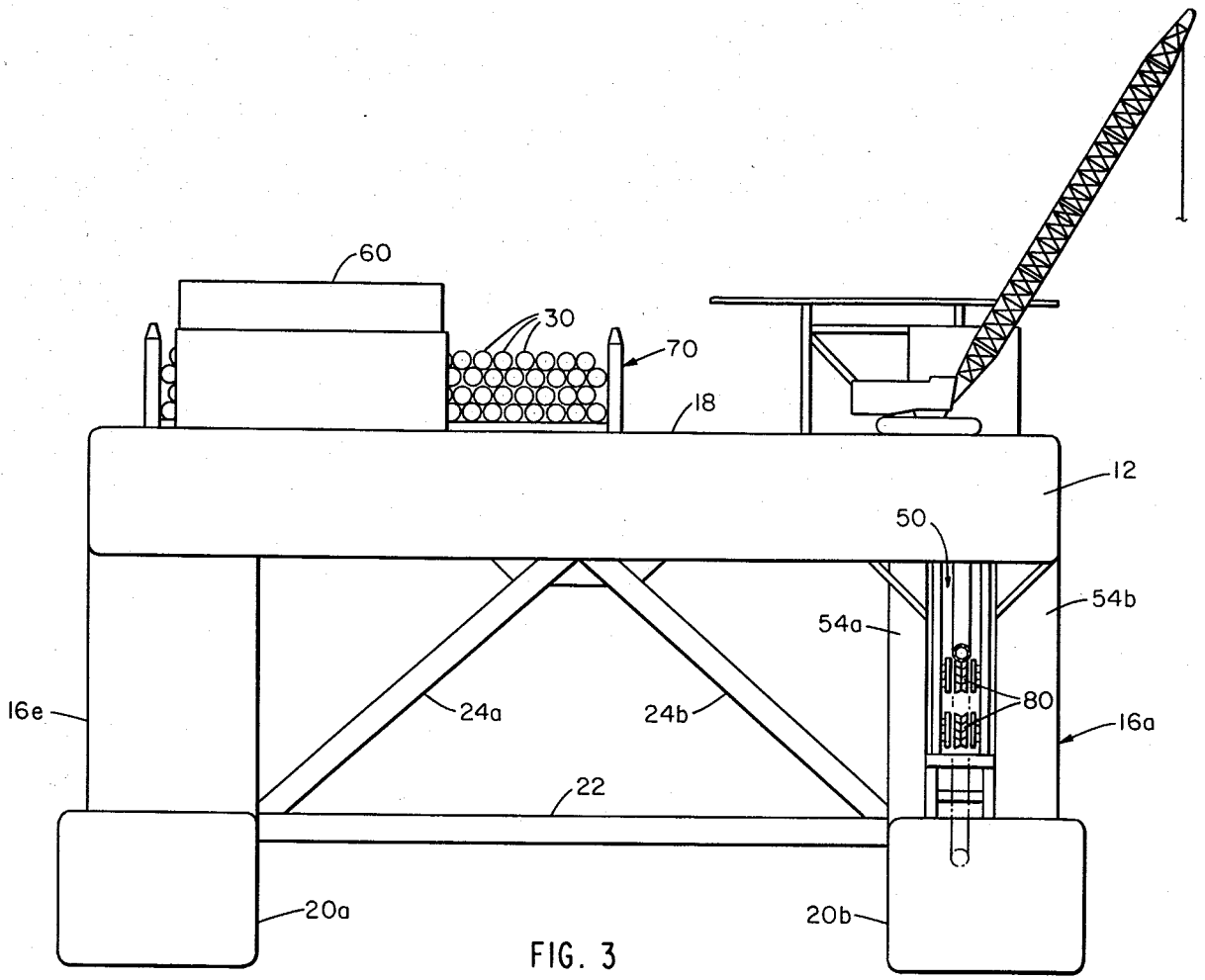
FIG. 3 is an end view taken from the stern of the vessel of FIG. 1.

Referring to FIG. 1, a semi-submersible vessel 10, constructed according to the invention, has an upper deck member 12, a lower submersible buoyancy member 14, and support members or columns 16 (columns 16*a*, 16*b*, 16*c*, 16*d*, and 16*e* being shown in FIGS. 1 and 3). The upper deck member provides an integral work surface 18 extending the entire length and width of the vessel; and the deck supports, at its upper surface 18, the operating systems for implementing the pipelaying operation.

The illustrated submersible buoyancy member 14 comprises two buoyancy members 20*a*, 20*b*, (FIG. 3) which extend substantially the entire longitudinal length along port and starboard sides of the vessel respectively. The support members 16 are spaced apart along the longitudinal length of the vessel between the upper deck member 12 and the buoyancy members 20*a* and 20*b*, and support the upper deck member in a spaced-apart relationship with respect to the buoyancy members 20*a* and 20*b*. Internal bracing and structural support is further provided by laterally extending members 22 and diagonally extending structural members 24*a* and 24*b*. Members 22, 24*a*, and 24*b* are periodically spaced in a repeating pattern along the longitudinal length of the vessel and preferably coincide with the longitudinal positions of support columns 16.

The pipeline assembly process is carried out at a plurality of operating stations situated along a pipeline path 26. Pipeline path 26 defines the path of pipe movement from the assembly starting position 28, illustrated as extending from the bow of the vessel to the water surface although other starting positions can be chosen. The pipeline path extends in a vessel longitudinal direction. At the assembly starting position 28, individual pipeline sections or pipelengths 30 are assembled into a defined starting position and are welded in a defined sequence, at successive stations 33 to form a continuous pipeline. The operating stations further include, in the illustrated embodiment, a plurality of tensioning stations 34 and pipeline support stations 36. The pipeline support stations direct and guide the pipeline into the body of water.

Figure 2:
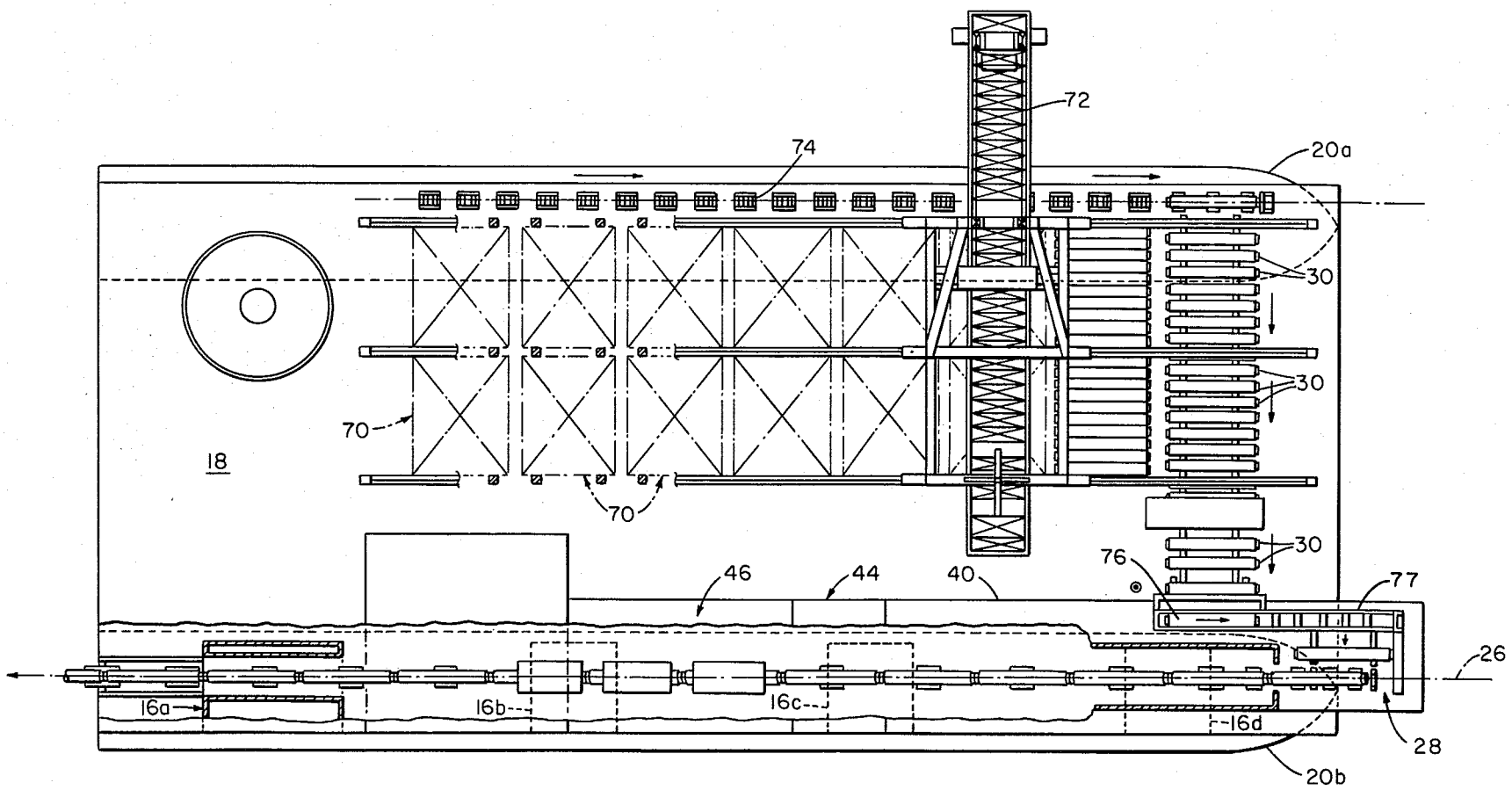
FIG. 2 is a top plan view of the semi-submersible vessel of FIG. 1 according to the preferred embodiment of the invention.

Referring to FIGS. 1 and 2, the illustrated pipeline path 26 extends along the starboard side of the vessel directly over the column members 16*a*, 16*b*, 16*c*, 16*d*. At the bow of the vessel, the pipeline path is elevated above the upper surface 18 of the upper deck member and is supported by a ramp section 40 which has an inclined upper surface 42 for substantially its entire length. The pipeline, as it proceeds successively through the various operating stations, is directed toward the water surface; and, approximately at the midsection 44 of the vessel, it begins to pass through the upper deck member at a longitudinally directed pass-through opening 46 in the deck member. The upper deck pass-through opening allows free movement of the pipeline through the deck member and the pipeline continues to be supported by the inclined ramp section 40 as it passes through the upper deck member.

It will be recalled that the pipeline path according to the invention, unlike earlier semi-submersible pipelaying vessels, extends over support members 16. Thus, members 16 have longitudinally directed vertical cut-away sections 50 to permit free passage of the pipeline. Thus, as the pipeline continues along the pipeline path from the deck pass-through opening, it passes through the cut-away section 50. In the illustrated embodiment, it is only the sternmost starboard column member 16*a* which has the required section 50. In other embodiments of the invention, additional columns may have cut-away sections 50.

The cut-away section 50, in the illustrated embodiment, extends the full vertical distance between the deck member 12 and the starboard buoyancy member 20*b* (FIG. 3), and divides illustrated support member 16*a* into port and starboard subsections 54*a*, 54*b*. Subsections 54*a*, 54*b* support elements for supporting and directing the pipeline to the water bottom. The pipeline then enters the water at a designated location and angle as is well known in the art.

The upper surface of the vessel supports, inter alia, a crane member 60 (FIG. 3) at the stern of the vessel, and the resulting weight distribution requires an increased buoyancy at the stern. Column member 16*a*, and hence the subsections 54*a* and 54*b*, which are, like the other column members 16, preferably buoyant, correspondingly have a greater longitudinal width than the corresponding longitudinal widths of support elements 16*b*, 16*c*, 16*d* and 16*e*. The subsections 54*a*, 54*b* longitudinal widths provide a horizontal cross section for column member 16*a* equal to the horizontal cross section of column member 16*e* and greater than the horizontal cross sections of the other column members. The subsections 54*a* and 54*b* also advantageously provide protection for the pipeline against lateral disturbing forces as the pipeline passes within the sphere of influence of sea created wave action. This protection advantageously reduces lateral movement and increases stability of the pipeline in its below deck travel region, a region wherein the pipeline is especially vulnerable to unstabilizing wave action forces.

In operation, referring to FIG. 2, the semi-submersible vessel stores a plurality of pipelengths 30 in bays 70. The pipelengths are individually transported from the bays, in a predetermined sequence, by an overhead crane 72, and are loaded onto the longitudinal roller-guiding pipelength path indicated by dot-dashed line 74. At the bow portion of that longitudinal path, the pipelengths substantially traverse the beam of the vessel to a position indicated at 76. The pipelengths then traverse, in a longitudinal direction, a guide member 77 on the ramp section 40 and assume a position opposite the beginning of the pipeline path 26.

The various operating stations positioned along the pipeline path can have any desired operational configuration and sequence so long as there results at the stern of the vessel a continuous pipeline having the characteristics desired for the particular pipeline application. The exiting pipeline is directed toward the water and is supported in its longitudinal traverse of the vessel by support shoes and rollers 78 which can be supported by either the upper deck 12, the ramp upper surface 42, or column members 16. In the illustrated embodiment, the pipeline is supported primarily by the ramp upper surface 42. At column member 16*a*, the ramp is supported by the column member 16*a* and the pipeline is positioned by a shoe hydraulically moveable with respect to the column supported extension 79 of ramp 40. The pipeline guide supports or shoes 78 comprise rollers 80, hydraulically positionable in the vertical direction and notched to support and guide the pipeline along the pipeline path (FIG. 3).

While the illustrated embodiment depicts the slotted column member 16*a* set in somewhat, longitudinally, from the sternmost portion of the vessel, in other embodiments of the invention, the column can be provided at the extreme stern of the vessel. The provision of column 16 at the sternmost position provides support for the pipeline as it exits from the vessel as described above, provides lateral protection against wave action as the pipeline exits from the vessel as described above, and performs the same buoyancy function as does column 16*a* of the described embodiment.

ADVANTAGES OF THE INVENTION AND UNOBVIOUSNESS

The claimed invention thereby advantageously provides a semi-submersible vessel having a work area which can be modelled after the work area of an existing conventional pipelaying vessel because the pipeline path extends longitudinally over the body of the vessel on either the port or the starboard side of the vessel.

This structure advantageously provides a stabilizing influence which effectively protects the pipeline from lateral forces as it traverses the vessel longitudinally and near the water level beneath the upper deck. The slotted column or support member, through which the pipeline passes, provides the lateral stability for the pipeline against wave action.

As a result, the claimed semi-submersible has an efficient deck area, does not require overhang for the pipeline which can result in both lateral instability and added fabrication costs, and allows known technologies, used in connection with other pipelaying vessels, to be easily and directly applied hereto.

The claimed semi-submersible differs significantly from its predecessors. The earlier vessels provided either a center ramp or an overhanging side ramp for the pipeline path. By providing a pipeline path which extends "through" the otherwise integral buoyant column member, i.e. by providing a slotted path through the column, a structurally advantageous vessel configuration is achieved, without undue costs or major reengineering of known technologies. In addition, the availability of the deck surface as an integral operating work area provides enormous advantage over, for example, the center ramp construction in which the deck surface is split in half by the pipeline path and its associated operating stations.

Additions, subtractions, deletions, and other modifications of the described preferred embodiment of the invention will be obvious to those skilled in the art, and are within the scope of the following claims.

What is claimed is:

1. A semi-submersible pipeline laying vessel comprising an upper deck member having a longitudinally directed pass-through opening, at least one lower submersible buoyancy member, a plurality of bow-to-stern spaced support members connected between said buoyancy member and said deck member for supporting said deck member in an upward, spaced-apart relationship with said buoyancy member, at least one of said support members at a stern portion of the vessel having a longitudinally directed vertical cut-away section extending through an interior section thereof to define port and starboard portions of said at least one support member, and said section being aligned with said deck opening, a pipelaying means partially supported by and above said deck member for fabricating a pipeline from a plurality of pipelengths, said pipelaying means comprising a plurality of operating stations arranged along a pipeline path, said path extending longitudinally of said vessel from an above deck position to a below deck position at the stern of said vessel, and in alignment with and passing through said deck pass-through opening and said one support vertical cut-away section, whereby said pipeline is at least partially shielded from port and starboard directed lateral wave action forces by said one support when said pipeline is below the level of said deck member.

2. The vessel of claim 1 wherein said pipelaying means comprises means supported by said at least one support member.

3. The vessel of claim 1 wherein said deck opening is positioned toward the stern of the vessel.

4. In a semi-submersible pipeline laying vessel having an upper deck member, at least two lower submersible buoyancy members, a plurality of bow-to-stern spaced support members connected between said buoyancy member and said deck member for supporting said deck member in an upward, spaced-apart relationship with said buoyancy member, and a pipelaying means at least partially supported by and above said deck member for fabricating a pipeline from a plurality of pipelengths, said pipelaying means defining a pipeline path, the improvement comprising at least one support member at the stern of the vessel having a vertical cut-away section passing through an interior portion thereof to define port and starboard portions of said at least one support member, the deck member having a pass-through opening aligned with said cut-away section, and said pipelaying means having means for directing said pipeline path through said pass-through section and through said cut-away section, whereby said pipeline is at least partially shielded from port and starboard directed lateral wave action forces by said one support member when said pipeline is below the level of said deck member.

5. The pipeline laying vessel of claim 4 wherein each said one support member has a horizontal cross-sectional area at least equal to the horizontal cross section of each said other support member.

6. The pipeline laying vessel of claim 5 wherein each said one support member has a longitudinal length greater than the longitudinal length of each said other support member.

7. A semi-submersible pipeline laying vessel comprising an upper deck member having a longitudinally directed pass-through opening, at least two lower submersible, laterally spaced buoyancy members, a plurality of bow-to-stern spaced support members connected between said buoyancy members and said deck member for supporting said deck member in an upward spaced-apart relationship with said buoyancy member, at least one of said support members at a stern portion of the vessel having a longitudinally directed vertical cut-away section aligned with said deck opening, and extending substantially the entire height of the support between the deck and the buoyancy members and dividing said one support into port and starboard support subsections, a pipeline means partially supported by and above said deck member for fabricating a pipeline from a plurality of pipe-lengths, said pipeline means comprising a plurality of operating stations arranged from a pipelane path, said path extending longitudinally of said vessel from an above deck position to a below deck position at the stern of the vessel, and in alignment with and passing through said deck and said one support vertical cut-away section, whereby said pipeline path be adjusted in a vertical direction and said pipeline is at least partially shielded from lateral wave action forces by one support when said pipeline is below the level of said deck member.

8. The vessel of claim 7 wherein each support member has a preselected buoyancy capacity and said at least one support member has a buoyancy capacity at least equal to the buoyancy of the other support members.

* * * * *